United States Patent [19]

MacIntyre et al.

[11] Patent Number: 4,951,972

[45] Date of Patent: Aug. 28, 1990

[54] ROTATABLE SEALING ASSEMBLIES

[75] Inventors: Brian MacIntyre, Milngavie; Frank Close, Airdrie; Sean McAvoy, Coatbridge, all of Scotland

[73] Assignee: Cooper Industries, Inc., Houston, Tex.

[21] Appl. No.: 382,530

[22] Filed: Jul. 20, 1989

[30] Foreign Application Priority Data

Jul. 22, 1988 [GB] United Kingdom ..... 8817555

[51] Int. Cl.[5] ..... F16L 21/08; F16L 19/065

[52] U.S. Cl. ..... 285/23; 285/133.2; 285/309; 285/341; 285/140

[58] Field of Search ..... 285/23, 133.2, 140, 285/305, 308, 309, 313, 341; 166/77.5, 84, 88

[56] References Cited

U.S. PATENT DOCUMENTS

| | | | |
|---|---|---|---|
| 1,650,102 | 11/1927 | Tschappat | 285/309 X |
| 2,134,311 | 10/1938 | Minor et al. | 285/133.2 X |
| 2,313,169 | 3/1943 | Penick et al. | 285/133.2 X |
| 2,599,039 | 6/1952 | Baker | 285/282 X |
| 3,287,030 | 11/1966 | Crain et al. | 285/140 X |
| 3,688,841 | 9/1972 | Baugh | 285/140 X |
| 4,209,193 | 6/1980 | Ahlstone | 285/309 |
| 4,343,495 | 8/1982 | Nobileau et al. | 285/23 |

*Primary Examiner*—Randolph A. Reese
*Assistant Examiner*—Jeffrey L. Thompson
*Attorney, Agent, or Firm*—David A. Rose

[57] ABSTRACT

The invention relates to a method and apparatus suitable for angularly adjusting an attachment member to be sealed to a bore, for example a wellhead body (2) in the bore of a conductor (4). The attachment body (2) is to be sealed through the intermediary of a housing (6) and a metal-to-metal wedge seal. A support ring (14) encircling the external peripheral surface of the housing (6) is movable between two axially spaced positions on the peripheral surface, and movable pins are provided to maintain the support ring (14) in a first, out-of-the-way position until the housing (6) is positioned in the bore (4) mouth, the pins (9) being releasable to permit axial movement of the annular support member ring (14) from the first position towards a second position in which the member body (2) is in direct contact with the bore mouth. There are further provided ball bearings (8) for permitting rotation between the body (2) and the housing (6) prior to the support ring (14) taking up its second position, the pins (9), when withdrawn, then acting to immobilize rotation between the body (2) and the housing (6). Screws (26) are then used in a conventional manner to energize the sealing device when the support member ring (14) is in its second position.

8 Claims, 1 Drawing Sheet

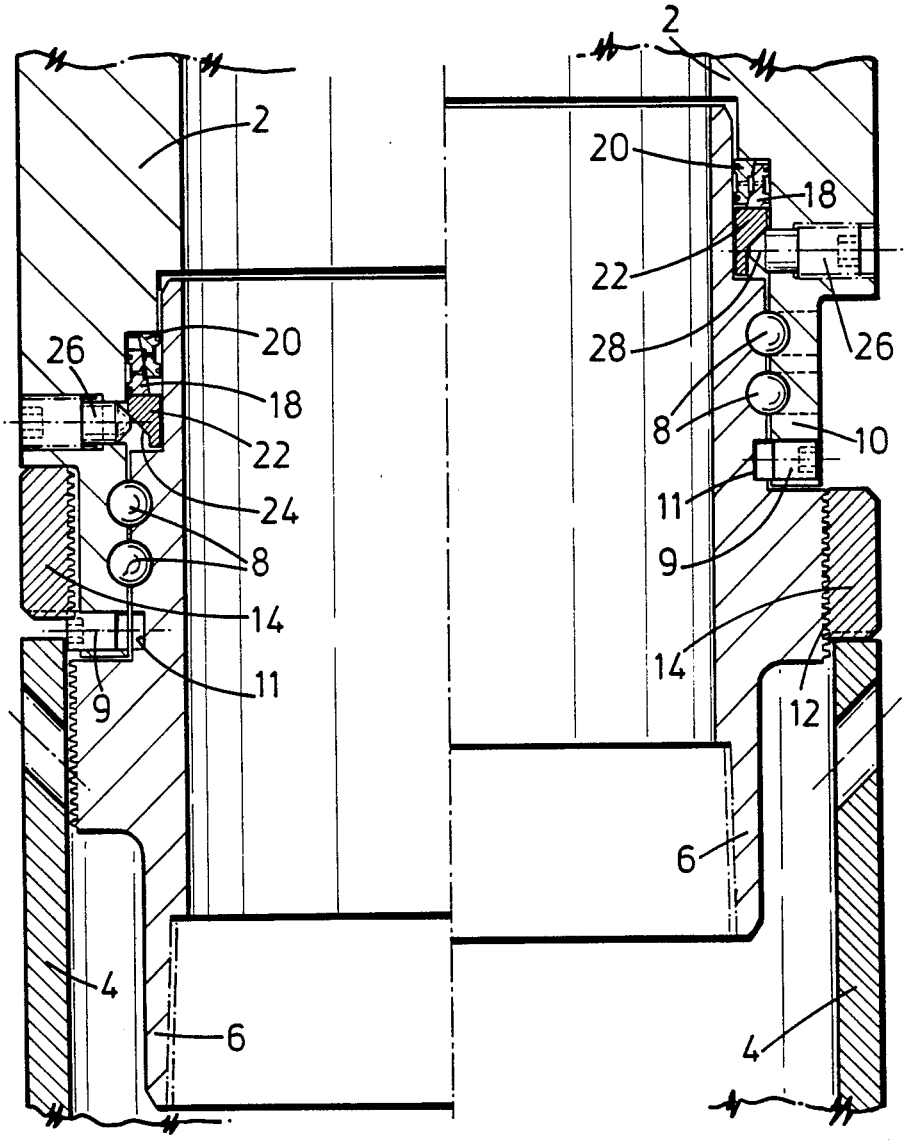
2
2
20
18
22
28
26
26
20
18
22
24
8
8
10
11
9
14
14
11
9
12
6
4
6
4

ROTATABLE SEALING ASSEMBLIES

The invention relates to sealing assemblies, for example metal-to-metal seals, in which adjusting, rotary, movement is available prior to the energisation of the seal.

Metal-to-metal seals are preferable to other types in many situations, for example, in the oil drilling industry where wellhead seals must withstand high temperatures and pressures, thermal cycling and chemical attack.

It is well known for a metal-to-metal seal of the wedge type successfully to be used in connection with the packoff element of the wellhead drill assembly. This type of wedge seal, known as a Canh seal, comprises two metal seal rings each having complementary frusto-conical confronting surfaces and which are received one within the other. The outer ring may, for example, seal the inner surface of the wellhead wall and the inner ring seals against the outer peripheral surface of the casing or mandrel hanger.

Axial compressive force applied to the rings produces controlled radial expansion so that contact is made between convex annular ribs on the seal rings and the wall surfaces to the sealed. These ribs comprise two pairs of ribs on each surface adapted to contact a wall surface.

However, difficulty is sometimes encountered, due to the environment characteristics associated with such wellhead locations, in the correct orientation of the wellhead body about its longitudinal axis with respect to the desired direction of its outlets once the seal is made and energised.

The invention therefore seeks to provide for rotary adjusting movement to mitigate the above difficulties.

The invention provides in accordance with one aspect thereof, a method of adjusting relatively rotatable members of an annular assembly including an attachment member to be sealed with respect to a bore through the intermediary of a tubular housing, a sealing device operable by compression of two annular sealing members thereof to produce an increased radial diameter, comprising the steps of inserting the housing of said assembly into the bore, suspending the housing at a predetermined position with respect to the mouth of the bore, causing an annular support member encircling the housing to be positioned at a predetermined distance spaced from but confronting rim portions of the bore mouth, rotating said attachment member about its longitudinal axis into a desired angular orientation with respect to the bore mouth by means of rotational adjustment means, immobilising said rotational adjustment means and moving the annular support member through said predetermined distance so as to contact the rim portions of the bore mouth prior to the energisation of the annular sealing members of the sealing device.

The invention provides, in another of its aspects, an adjustment device for relatively rotatable members of an annular sealing assembly, said assembly including an attachment member to be sealed with respect to a bore through the intermediary of a housing, and a sealing device operable by compression in an axial direction of two annular sealing members thereof to produce an increased radial diameter, wherein the adjustment device comprises said housing which is adapted to be received within a mouth of the bore, an annular support member encircling the external peripheral surface of the housing and movable between two axially spaced positions on said peripheral surface, means to maintain said support member in a first, out-of-the-way position until the housing is positioned in the bore mouth, said means being releasable to permit axial movement of the annular support member from said first position towards a second position in which said member is in direct contact with said bore mouth, there being further provided rotational adjustment means permitting rotation between said attachment member and said housing prior to the support member taking up its second position, means to immobilise said adjustment means and means to energise said sealing device when the support member is in its second position.

Preferably, the sealing device is a wedge (Canh) seal and the rotational adjustment means are spherical bearing members, said means to immobilise these comprising locking pins. Conveniently, said locking pins in their unlocked position may comprise means to retain the annular support means in its first position.

There will now be described an example of an assembly according to the invention. It will be understood that the description which is to be read with reference to the drawings, is given by way of example only and not by way of limitation.

The drawing is a composite sectional view taken on a longitudinal plane through the device. The left hand side illustrates the assembly in a running mode ready for positioning and the right hand side shows the assembly in an energised position.

The assembly comprises a wellhead body 2 which is to be positioned with respect to the mouth of a bore of a hollow support tube 4, known as a conductor, within which is adapted to be received a casing (not shown) secured to an internally threaded lower portion of a casing hanger, comprising a housing 6.

The housing 6 is rotatably mounted upon the body 2 to enable the body to be attached to the well system in a desired orientation, i.e. to position wellhead body outlets (not shown) at the correct directional angle.

Rotation between the body 2 and the housing 6 is enabled by the provision of rolling members 8, which in the present example are spherical, received in confronting grooves formed in a lower portion 10 of the body 2 and an upper portion of the housing 6 respectively.

When the desired orientation of the body 2 is achieved, further rotation may be prevented by means of radially movable retention pins 9 which are received in bores in the lower portion 10 of the body 2 and enter appropriate ones of a series of recesses 11 in the housing 6. Conveniently a first number of pins, which may, if desired, be an odd number, is provided and a second, different, number of recesses, which may be an even number, so that pins are equidistantly spaced apart by a distance which differs from the distance by which the recesses are equidistantly spaced. The provision of an adequate number of pins and recesses spaced at differing distances ensures co-operation of sufficient of the pins and recesses to achieve a locking effect.

An external threaded portion 12 is provided at an intermediate region of the housing 6 and is adapted to receive, in a manner to be explained below, an annular support member in the form of an internally threaded support ring 14.

An annular wedge seal device of the type known as a Canh seal is provided between the wellhead body 2 and the housing 6. The seal comprises an outer sealing ring 18 having an inner frusto-conical surface tapering at an angle identical to that of the exterior of an inner sealing ring 20. As will be apparent from comparison of the two views of the drawing, in the running mode, the two sealing rings 18,20 are arranged so as to be partly displaced in an axial direction and to be more or less arranged in the same radial plane in the energised mode to achieve the desired radial expansion.

The energisation of the sealing device is obtained by the action of a loading ring 22 which is in contact with a lower surface of the outer sealing ring 18. The ring 22 is provided with a frusto-conical surface portion 24 against which bear a plurality of energising screws 26, each having a conical operating surface 28 which bears against the surface portion 24 to determine the position of the ring 22, i.e. raising the ring when the screws 26 are rotated so as to move radially inwardly.

The operation of the assembly is as follows:

Before positioning of the assembly within the conductor mouth 4 is commenced, the support ring 14 is screwed onto the housing 6 so as to clear the threaded portion 12 and to be received immediately below the array of screws 26 as shown in the left-hand side of the drawing, i.e. the running mode. To retain the ring in this position a selected number of the retention pins 9 may be moved radially outwardly of their bores as illustrated.

The casing (not shown) is threaded into the tonging neck of the casing hanger (the housing 6) and the assembly is lowered by suitable lifting gear into the conductor 4 until a reference level known as a mudline is reached. The assembly may then be raised by a predetermined amount, which is dependent on the dimensions of the installation, and suspended at the required level.

When the retention pins 9 are screwed inwardly of the housing 6, the support ring 14 is free to be lowered to a position in which it can be screwed onto the external threaded portion 12 of the housing 6 until the ring is spaced only slightly from the rim of the conductor 4. It is important that the ring 14 and the rim are not in contact at this point.

The wellhead body 2 may now be rotated as desired to orientate the outlets with the correct position. When this is achieved, appropriate ones of the retention pins 9 are torqued into aligned recesses 11 to prevent further rotation.

The support ring 14 is now lowered into contact with the rim of the conductor 4.

The energising screws 26 are then moved inwardly, according to known procedures, so as to raise the loading ring 22 and to bring the sealing rings 18,20 into their energised positions, and the installation is complete. Standard sealing tests may then be carried out as required.

Various modifications may be made within the scope of the invention as defined in the following claims.

We claim:

1. A method of adjusting relatively rotatable members of an annular assembly, the annular assembly including an attachment member to be sealed with respect to a bore through the intermediary of a tubular housing, which is supported within a support tube and a sealing device operable by compression of two annular sealing members to produce an increased radial diameter thereof for sealing said attachment member with respect to said tubular housing, the method comprising the steps of inserting the housing of said assembly into the support tube, suspending the housing at a predetermined position with respect to the support tube, causing an annular support member encircling the housing to be positioned at a predetermined distance spaced from but confronting a rim portion of the support tube, rotating said attachment member about its longitudinal axis into a desired angular orientation with respect to the support tube by a rotational adjustment means, operating a means to immobilise said rotational adjustment means, moving the annular support member through said predetermined distance so as to contact the rim portion of the support tube prior to the compression of the annular sealing members of the sealing device, and compressing said annular sealing members.

2. A method as claimed in claim 1, wherein the housing is suspended at said predetermined position at a level lower than the final desired position.

3. A method as claimed in claim 1, comprising the steps of (a) positioning the annular support member on the attachment member so as to be at a level between the annular sealing members and the means provided to immobilise said rotational adjustment means (b) lowering the assembly into said support tube to a level lower than said predetermined position and bringing it up to said predetermined position, (c) moving the annular support member towards the rim of the support tube to a position adjacent to but not in contact with the rim and performing said steps of (d) rotating the attachment member about its longitudinal axis to the desired angular orientation (e) operating the means to immobilise the rotational adjustment of the attachment member and (f) further moving the annular support member into contact with the rim of the support tube.

4. An adjustment device for relatively rotatable members of an annular sealing assembly, including an attachment member to be sealed with respect to a bore through the intermediary of a tubular housing which is supported within a support tube, a sealing device comprising two annular sealing members, compression of which in an axial direction produces an increased radial diameter thereof for sealing said attachment member with respect to said tubular housing, the device further comprising said tubular housing having a peripheral surface, an annular support member encircling said housing and movable axially thereof between two axially spaced positions on said peripheral surface, retaining members to maintain said support member in a first, out-of-the-way position until the housing is positioned in the bore, said retaining members being releasable to permit axial movement of the annular support member from said first position towards a second of said positions in which said member is in direct contact with a rim portion of said support tube, rotational adjustment means permitting rotation between said attachment member and said housing prior to the support member taking up its second position, an immobilisation means to immobilise said rotational adjustment means and an energisation ring means to energise said sealing device by axial compression when the support member is in its second position.

5. A device as claimed in claim 4, wherein said immobilisation means comprises a plurality of pin members, and said housing is provided with a plurality of recesses in its peripheral surface, each said pin being movable in a radial manner with respect to the housing between an inward position in which at least some of the pins are engaged in appropriate ones of said recesses and an outwardly extending position in which the pins project from the attachment body.

6. A device as claimed in claim 4, wherein said immobilisation means and said retaining members are integral and are comprised by pin members, which act as said immobilisation means when in a first inward position and as said retaining members when in a second outwardly extending position.

7. A device as claimed in claim 4, wherein the rotational adjustment means comprise ball or roller bearings.

8. A device as claimed in claim 4, wherein a portion of said external peripheral surface of the housing is threaded so as to be engaged by an internally threaded portion of the annular support member when in its second position.

* * * * *